US006026267A

United States Patent [19]

Kimura

[11] Patent Number: 6,026,267

[45] Date of Patent: Feb. 15, 2000

[54] IMAGE FORMING APPARATUS INCLUDING A PRE-TRANSFER ERASER

[75] Inventor: Akio Kimura, Shizuoka-ken, Japan

[73] Assignee: Minolta Co., Ltd., Osaka, Japan

[21] Appl. No.: 09/205,327

[22] Filed: Dec. 4, 1998

[30] Foreign Application Priority Data

Dec. 5, 1997 [JP] Japan ..... 9-335790

[51] Int. Cl.[7] ..... G03G 15/00; G03G 15/16

[52] U.S. Cl. ..... 399/296; 399/66; 399/156

[58] Field of Search ..... 399/296, 127, 399/128, 156, 38, 48, 66; 430/126, 902

[56] References Cited

U.S. PATENT DOCUMENTS

| | | | |
|---|---|---|---|
| 4,931,839 | 6/1990 | Tompkins et al. | 399/66 |
| 5,166,734 | 11/1992 | Pinhas et al. | 399/390 |
| 5,260,752 | 11/1993 | Fuma et al. | 399/296 X |
| 5,333,037 | 7/1994 | Inuoe et al. | 399/66 X |
| 5,459,563 | 10/1995 | Fuma et al. | 399/296 X |
| 5,480,751 | 1/1996 | Williams et al. | 430/902 X |
| 5,614,998 | 3/1997 | Sanpe | 399/296 X |
| 5,729,808 | 3/1998 | Bisaiji | 399/296 |
| 5,734,951 | 3/1998 | Maekawa et al. | 399/169 |
| 5,895,738 | 4/1999 | Parker et al. | 399/156 X |

FOREIGN PATENT DOCUMENTS

| | | |
|---|---|---|
| 63-274974 | 11/1988 | Japan . |
| 63-292165 | 11/1988 | Japan . |
| 7-56447 | 3/1995 | Japan . |
| 9-101687 | 4/1997 | Japan . |

*Primary Examiner*—Arthur T. Grimley
*Assistant Examiner*—Sophia S. Chen
*Attorney, Agent, or Firm*—Morrison & Foerster LLP

[57] ABSTRACT

When image areas pass the pre-transfer eraser, a control unit sets the light quantity of the pre-transfer eraser so that the potential of the background areas changes to reduce the difference from the potential of the visible image areas. A pre-transfer surface potential of the background areas in the image areas is controlled to a level that prevents the central parts of letters from missing and restrains the spread of toner in the periphery of letters. When the non-image areas pass the pre-transfer eraser, the control unit sets the light quantity of the pre-transfer eraser so as to be larger than that of the case when the image areas are exposed. Specifically, the control unit sets the light quantity of the pre-transfer eraser so that the surface potential of the non-image areas is reduced to the residual potential level of the photoreceptor surface having passed a charge removing unit.

13 Claims, 4 Drawing Sheets

IMAGE FORMING APPARATUS INCLUDING A PRE-TRANSFER ERASER

This application is based on application No. 9-335790 filed in Japan, the contents of which is hereby incorporated by reference.

BACKGROUND OF THE INVENTION

1. Field of the Invention

The present invention relates to an image forming apparatus using the electrophotographic process to perform image formation, and more specifically, to an image forming apparatus in which the charges of the photoreceptor surface are removed before the toner image formed on the photoreceptor surface is transferred to a sheet of paper.

2. Description of the Related Art

In image forming apparatuses using the electrophotographic process to perform image formation, generally, after the surface of the photoreceptor is uniformly charged by the charger, the photoreceptor surface is exposed in accordance with data on the original image, thereby forming an electrostatic latent image. Using toner charged to a polarity the same as the polarity of the electrostatic latent image, a potential the same in polarity as the potential of the latent image and higher in level than the potential of the latent image is applied to the developer roller to cause toner to adhere to the photoreceptor where the latent image is formed, so that the latent image is transformed into a visible image (reversal development). Then, the toner image is transferred to a sheet of paper and fixed by heat or pressure. The toner and the latent image charges remaining on the photoreceptor surface are removed by a cleaning unit such as an urethane rubber blade and a charge removing unit performing uniform exposure, respectively.

On the photoreceptor surface having undergone toner development, as shown in FIG. 2(*a*), a difference |Vn−Vd| occurs between the potential Vn of the background area (the part to which no toner adheres) and the potential Vd of the toner surface of the visible image area (the part to which toner (represented by ○ in the figure) adheres). When the difference is large, the formation of the transfer electric field in the transfer process is adversely affected, so that an area in which the electric field is comparatively weak is formed immediately inside the edge of the visible image area. As a result, toner is not easily transferred inside the edge in the central parts of letters and in solidly shaded images, that is, the central parts of letters are missing.

In a conventional image forming apparatus of this type, in order to prevent the central portions of letters from missing or being re-transferred, pre-transfer erasing is performed in which the charges of the photoreceptor surface to which toner adheres are removed before transfer by exposing the photoreceptor surface. For example, in an apparatus described in Japanese Laid-open Patent Application No. H9-101687, the pre-transfer erasing light quantity is set based on the setting of the grid potential of the charger or the potential of the photoreceptor surface detected by the potential sensor, and the charge removal amount is controlled based on the set light quantity. According to this configuration, as shown in FIG. 2(*b*), the potential of the background area changes from Vn to Vn', so that the difference from the potential Vd of the visible image area decreases. As a result, the central parts of letters are prevented from missing.

If the potential Vn of the background area is decreased to the residual potential level Vr of the photoreceptor surface having passed the charge removing unit before transfer, another problem arises that toner spreads in the periphery of letters at the time of transfer. Therefore, in the conventional example, the pre-transfer potential Vn of the background area is not reduced to as low as the residual potential level Vr. Moreover, in the conventional example, the pre-transfer erasing light quantity is always constant irrespective of the ratio of an image area to a non-image area.

As shown in FIG. 3, in the actual electrophotographic process, image formation processes B1, B2, . . . in which images are formed on the photoreceptor surface and non-image formation processes A, C, . . . , D in which no image formation is performed are repeated like pre-processing A→image formation B1→image interval C→image formation B2→image interval C→ . . . →image formation B4→post-processing D. As illustrated in FIG. 5 (showing the photoreceptor surface being developed), when the photoreceptor surface 1*a* is divided with respect to the rotation direction X, the image formation processes correspond to areas B1 and B2 on the photoreceptor surface 1*a* with which sheets P1 and P2 are in contact (the areas B1 and B2 will be referred to as "image areas"), whereas the non-image formation processes correspond to areas A, C and D other than the areas B1 and B2 (the areas A, C and D will be referred to as "non-image areas"). Areas G1 and G2 are background areas. Areas M1 and M2 are visible image areas.

Thus, in the actual electrophotographic process, since the image formation processes and the non-image formation processes are repeated, only by setting the pre-transfer erasing light quantity so that the surface potential difference |Vn−Vd| between the background areas and the visible image areas in the image areas is reduced without making distinction between the image areas and the non-image areas like in the conventional example, the surface potential is not completely smoothed in the non-image areas A, C and D as shown in FIG. 4(*a*). That is, in the non-image areas A, C and D, surface potential non-uniformity R1 caused in a stage T1 where the pre-transfer eraser has been passed but the charge removing unit has not been passed yet remains even in a stage T2 where the charge removing unit has been passed (but the charger has not been passed yet) (the residual non-uniformity caused in stage T2 is represented by R2). Consequently, charging non-uniformity R2 is caused in a stage T3 where the charger has been passed for the next image formation (the surface potential non-uniformity caused in stage T3 is represented by R3). Such a potential record (photoreceptor memory) leads to image quality degradation.

SUMMARY OF THE INVENTION

Accordingly, an object of the present invention is to provide an image forming apparatus in which the photoreceptor memory is reduced by appropriately setting the light quantity of the pre-transfer eraser.

To achieve the above-mentioned object, an image forming apparatus according to a first aspect is provided with: an image carrier; a charger which charges the image carrier; an exposing device which forms a latent image by exposing the charged image carrier; a developing unit which forms a visible image on the image carrier by developing the latent image; a transfer unit which transfers the visible image to a recording medium; a pre-transfer charge removing unit which removes charges of the image carrier before the visible image is transferred; and a controller which changes a charge removing quantity of the pre-transfer charge removing unit so that the charge removing quantity for a non-image area on the image carrier is larger than the charge removing quantity for an image area on the image carrier.

An image forming apparatus according to a second aspect is provided with: a photoreceptor being rotated; a charger which uniformly charges the photoreceptor surface; an exposing device which forms an electrostatic latent image on the photoreceptor surface; a developing unit which forms a toner image corresponding to the latent image by causing toner to adhere to the photoreceptor surface; a pre-transfer eraser which removes charges of the photoreceptor surface by exposing the photoreceptor surface after the toner image is developed; a transfer unit which transfers the toner image to a sheet of paper; a charge removing unit which removes charges of the photoreceptor surface after the toner image is transferred by the transfer unit; and a controller which controls the light quantity of the pre-transfer eraser so that the light quantity for a non-image area on the photoreceptor is larger than the light quantity for an image area on the photoreceptor, said non-image area is not in contact with the sheet of paper and said image area is to be in contact with the sheet of paper.

An image forming apparatus according to a third aspect is provided with: an image forming unit which forms a toner image on the image carrier based on an input image; a transfer unit which transfers the formed toner image to the recording medium; a pre-transfer eraser which irradiates the image carrier with light at a position in the upstream side of the transfer position; and a controller which controls the light quantity of the pre-transfer eraser so that the light quantity for a non-image area on the image carrier is larger than the light quantity for an image area on the image carrier.

In an embodiment, when the pre-transfer eraser exposes the non-image area, the control means sets the light quantity of the pre-transfer eraser so that the surface potential of the non-image area is reduced to a residual potential level of the surface of the image carrier having passed the charge removing means.

When the pre-transfer eraser exposes the image area, the control means can set the light quantity of the pre-transfer eraser to an optimum value so that the surface potential of a background area in the image area is at a level that prevents the central parts of letters from missing and restrains the spread of toner in the periphery of letters.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Hereinafter, the embodiment of the present invention will be described in detail.

Figure 1:
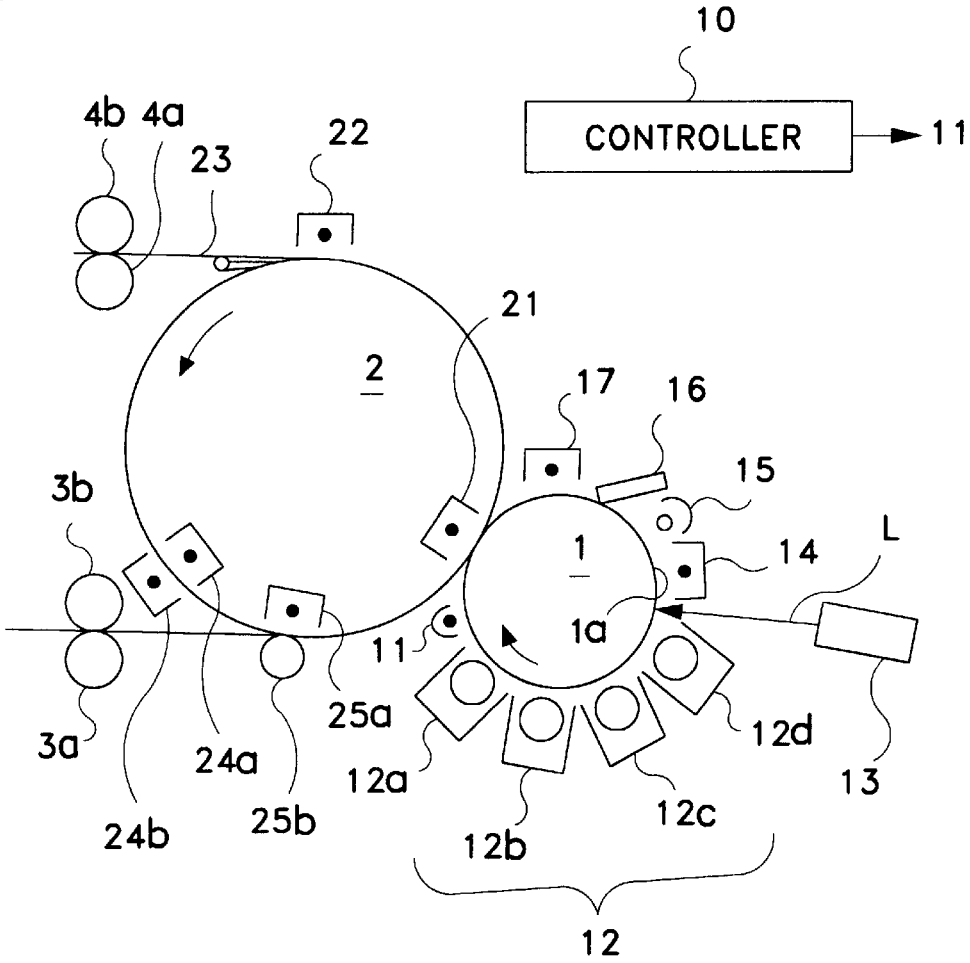
FIG. 1 schematically shows the structure of an image forming apparatus according to the embodiment of the present invention.

FIG. 1 schematically shows the structure of an image forming apparatus according to the embodiment.

The image forming apparatus has a photoreceptor drum 1 being rotated, and has the following elements around the peripheral surface of the photoreceptor drum 1 in the order mentioned: a charger 14 as charging means; a laser unit 13 as exposure means; a developing unit 12 as developing means; a pre-transfer eraser 11; a transfer drum 2 and a transfer charger 21 as transferring means; a pre-cleaner charger 17; a cleaning unit 16 such as an urethane rubber blade; and a charge removing unit 15 as charge removing means. The developing unit 12 comprises developing device 12*a* to 12*d* for cyan, magenta, yellow and black, respectively. The light quantity of the pre-transfer eraser 11 is controlled by a control unit 10 as control means. Specifically, the light quantity of the pre-transfer eraser 11 is switched between the image areas and the non-image areas on the photoreceptor surface as described later. The switching of light quantity of the pre-transfer eraser 11 can be achieved, for example, by changing current passed through the pre-transfer eraser 11 based on a signal from the control unit 10.

On the paper feed side of the transfer drum 2 are disposed conveying rollers 3*a* and 3*b*, an attracting charger 25*a*, an attracting roller 25*b*, and charge removing chargers 24*a* and 24*b*. On the paper discharge side of the transfer drum 2 are disposed a separating unit 22, a separating claw 23, and fixing rollers 4*a* and 4*b* as fixing means.

The image forming apparatus performs image formation in the following manner: First, the surface 1*a* of the photoreceptor drum 1 is uniformly charged by the charger 14. Then, the photoreceptor surface 1*a* is irradiated with a laser beam L by the laser unit 13 in accordance with data on the original image, thereby forming an electrostatic latent image on the photoreceptor surface 1*a*. Then, at the developing unit 12, using toner charged to a polarity the same as the polarity of the electrostatic latent image, a potential the same in polarity as the potential of the latent image and higher in level than the potential of the latent image is applied to the developer roller to cause toner to adhere to the latent image, so that the latent image is transformed into a visible image (reversal development). A sheet of paper supplied through the conveying rollers 3*a* and 3*b* is held on the transfer drum 2 by the attracting charger 25*a* and the attracting roller 25*b* and is brought into contact with the photoreceptor surface 1*a*. The toner image formed on the photoreceptor surface 1*a* is transferred to the sheet of paper. The sheet of paper to which toner adheres is separated from the transfer drum 2 by the separating unit 22 and the separating claw 23 and transmitted to the fixing rollers 4*a* and 4*b*. Then, the toner image is fixed by heat or pressure by the fixing rollers 4*a* and 4*b*. The toner and the latent image charges remaining on the photoreceptor surface 1*a* after transfer are removed by the cleaning unit 16 and the charge removing unit 15 performing uniform exposure, respectively.

Subsequently, control of switching of the light quantity of the pre-transfer eraser 11 will be described with reference to FIGS. 5 and 6.

Figure 2A:
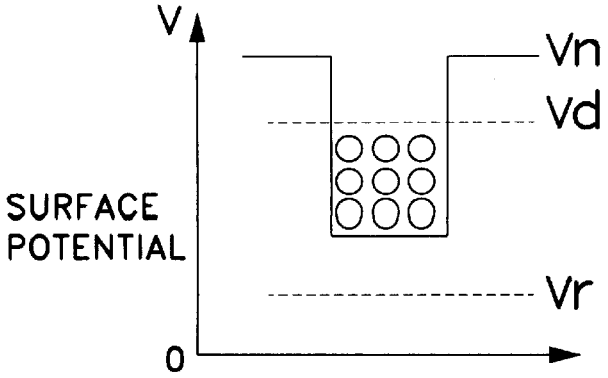
FIG. 2(*a*) and FIG. 2(*b*) show the potentials of the background areas and the visible image areas on the photoreceptor surface.
Figure 2B:
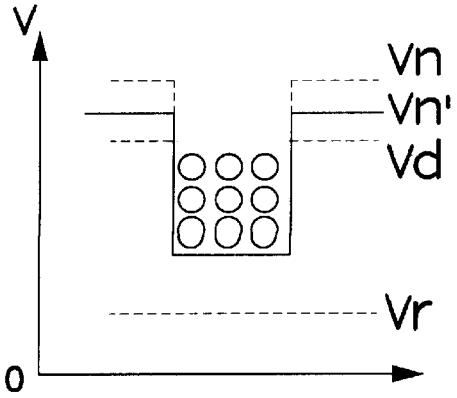
Figure 3:
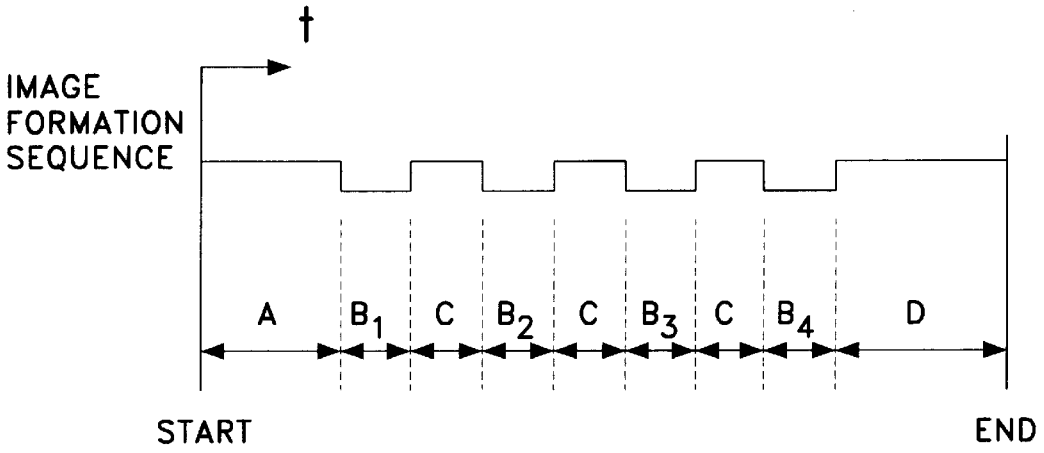
FIG. 3 shows the image formation sequence.
Figure 5:
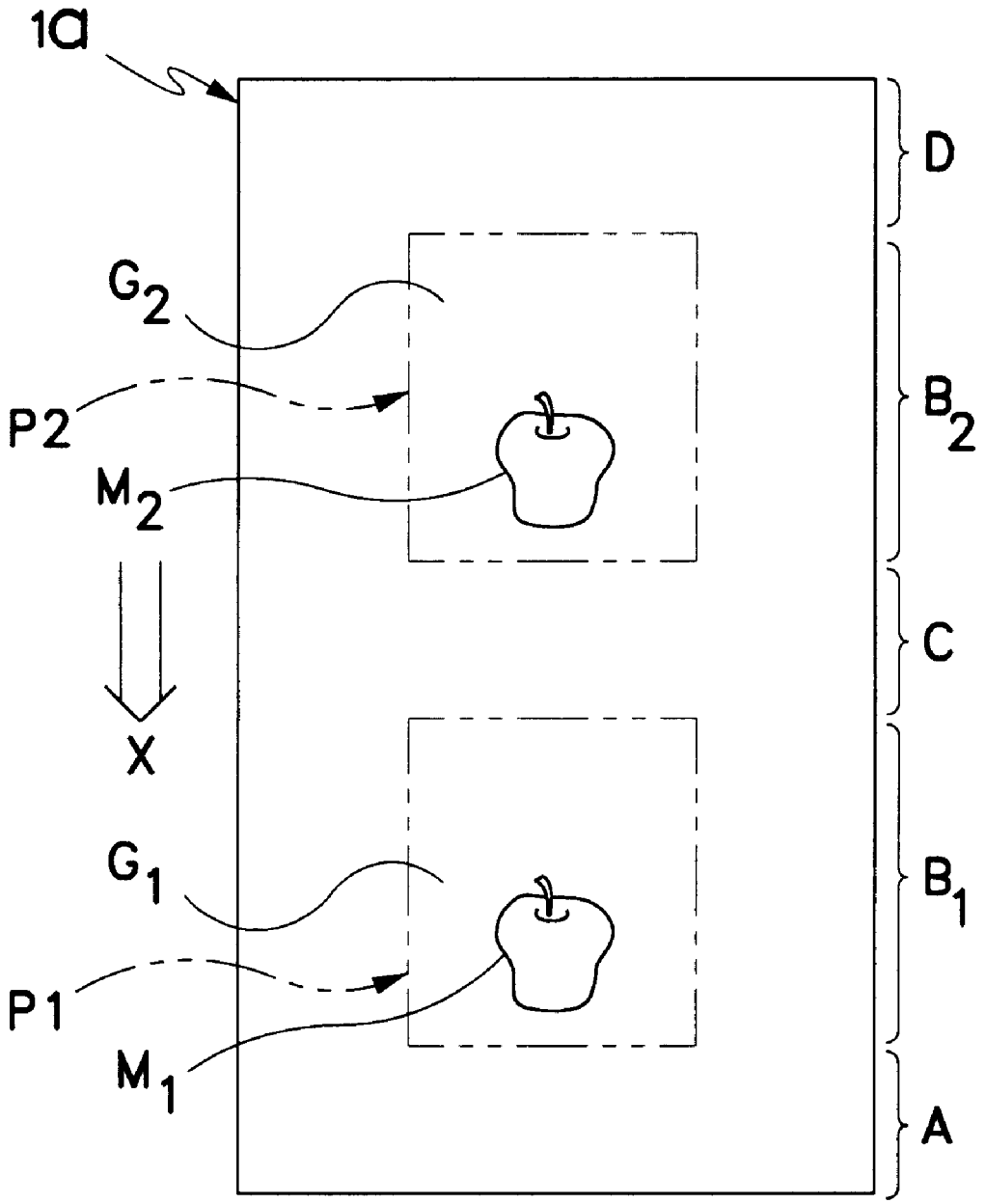
FIG. 5 shows the photoreceptor surface being developed with respect to the rotation direction.

As illustrated in FIG. 5 (showing the photoreceptor surface 1*a* being developed), the photoreceptor surface 1*a* on which toner images have been formed is divided with respect to the rotation direction X into the image areas B1 and B2 with which the sheets P1 and P2 are to be in contact and the non-image areas A, C and D other than the areas B1 and B2. As shown in FIG. 2(*a*), the potential Vn of the background areas G1 and G2 to which no toner adheres is higher than the potential Vd of the visible image areas M1 and M2 to which toner adheres.

Figure 6:
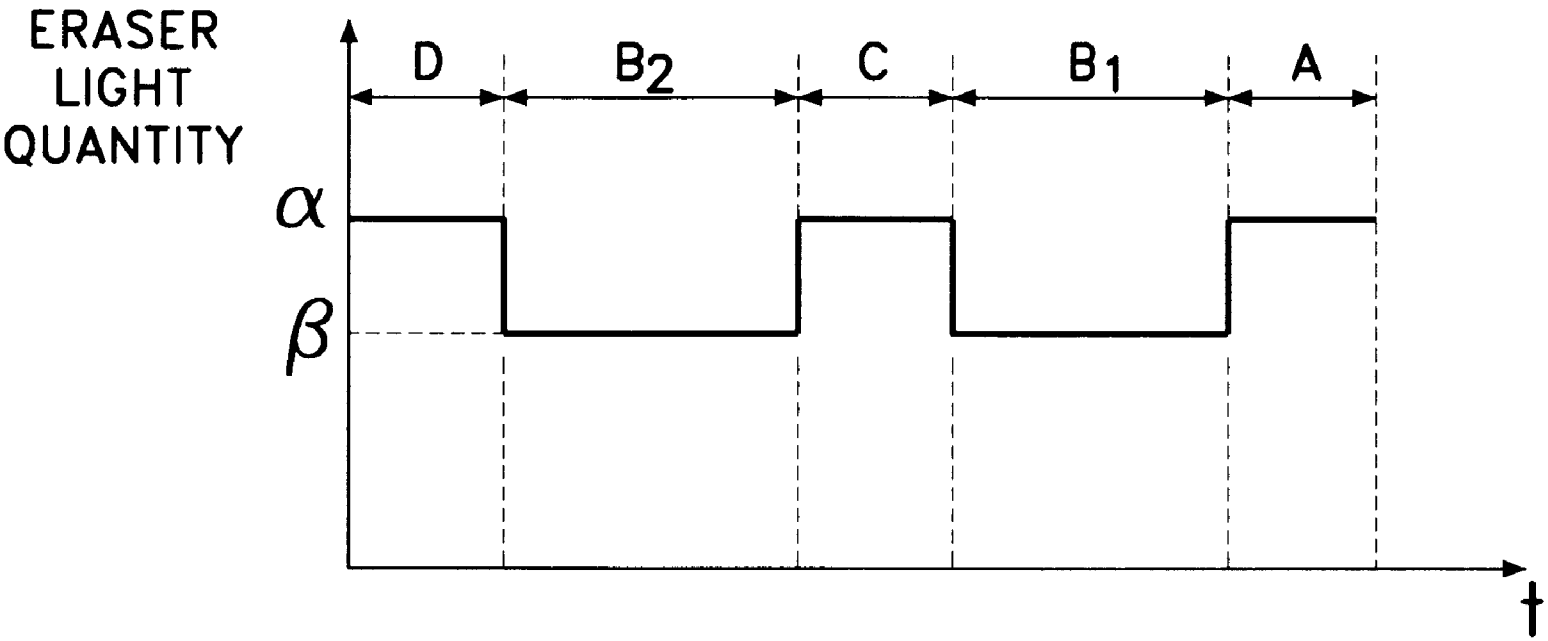
FIG. 6 shows the light quantities of the pre-transfer eraser corresponding to the areas on the photoreceptor surface.

In this embodiment, when the image areas B1 and B2 pass the pre-transfer eraser 11, the control unit 10 sets the light quantity of the pre-transfer eraser 11 so that the potential of the background areas G1 and G2 changes from Vn to Vn' to reduce the difference from the potential Vd of the visible image areas M1 and M2 (α of FIG. 6). Consequently, the central parts of letters are prevented from missing. If the potential Vn of the background areas G1 and G2 is reduced to as low as the residual potential level Vr of the photoreceptor surface having passed the charge removing unit 15 before transfer, toner spreads in the periphery of letters. Therefore, the potential Vn of the background areas G1 and G2 is not reduced to as low as Vr before transfer. That is, the pre-transfer surface potential of the background areas G1 and G2 in the image areas B1 and B2 is controlled to a level that prevents the central parts of letters from missing and restrains the spread of toner in the periphery of letters.

Figure 4A:
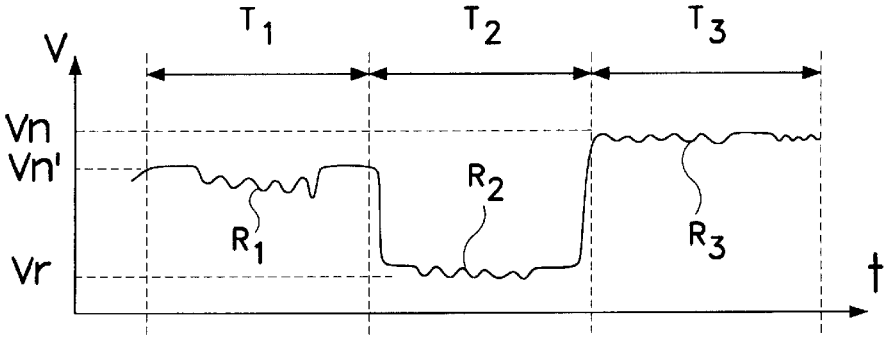
FIG. 4(*a*) and FIG. 4(*b*) show the surface potentials of the non-image areas on the photoreceptor surface in comparison between the conventional example and the present invention.
Figure 4B:
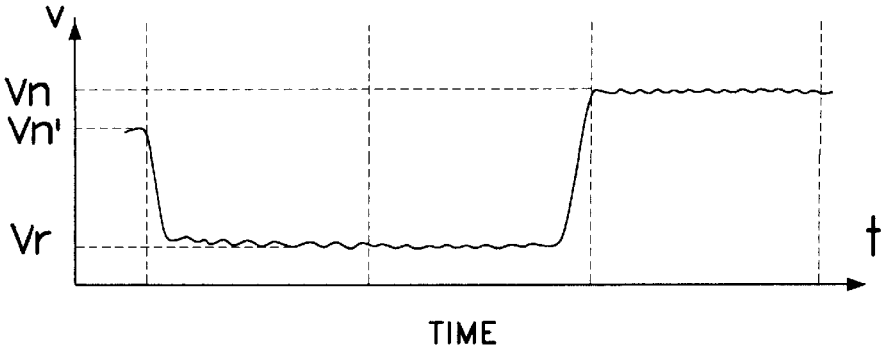

When the non-image areas A, C and D pass the pre-transfer eraser 11, the control unit 10 sets the light quantity of the pre-transfer eraser 11 so as to be larger than that of the case when the image areas B1 and B2 are exposed (β of FIG. 6). Specifically, the control unit 10 sets the light quantity of the pre-transfer eraser 11 so that the surface potential Vn of the non-image areas A, C and D is reduced to the residual potential level Vr of the photoreceptor surface having passed the charge removing unit 15. Consequently, as shown in FIG. 4(*b*), the surface potential of the non-image areas A, C and D is lower than the surface potential Vn of the background areas in the image areas B1 and B2 and reduced to the residual potential level Vr in the stage T1 where the pre-transfer eraser 11 has been passed but the charge removing unit 15 has not been passed yet, so that the surface potential of the non-image areas A, C and D is sufficiently smoothed in the stage T2 where the charge removing unit 15 has been passed. Consequently, the surface potential of the non-image areas A, C and D is sufficiently uniformized in the stage T3 where the charger 14 has been passed for the next image formation. Thus, the photoreceptor memory is effectively reduced. As a result, image quality degradation is prevented.

While in this embodiment, the photoreceptor surface is divided into the non-image areas and the image areas with respect to the rotation direction of the photoreceptor as shown in FIG. 5, the photoreceptor surface may be divided into the areas also with respect to the axial direction of the photoreceptor. In that case, as the pre-transfer eraser 11, one whose light quantity can be varied in the axial direction of the photoreceptor is used. With this configuration, the light quantity of the pre-transfer eraser 11 can be increased for all the areas other than the image areas P1 and P2 of FIG. 5 to be transferred to sheets of paper.

As is apparent from the above description, in the image forming apparatus of this embodiment, since the surface potential of the non-image areas on the photoreceptor surface is lower than the surface potential of the background areas in the image areas on the photoreceptor surface in the stage where the pre-transfer eraser has been passed but the charge removing means has not been passed yet, the surface potential of the non-image areas is sufficiently smoothed in the stage where the charge removing means has been passed. Consequently, the surface potential of the non-image areas is sufficiently uniformized in the stage where the charging means has been passed for the next image formation. As a result, the photoreceptor memory is reduced and image quality degradation is prevented.

Since the surface potential of the non-image areas is reduced to the residual potential level of the photoreceptor surface having passed the charge removing means in the stage where the pre-transfer eraser has been passed but the charge removing means has not been passed yet, the surface potential of the non-image areas is further smoothed in the stage where the charge removing means has been passed. As a result, the photoreceptor memory is further reduced.

While in this embodiment, the pre-transfer eraser is used for removing charges of the photoreceptor, a pre-transfer charger can be used for it.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising:

an image carrier;

a charger which charges the image carrier;

an exposing device which forms a latent image by exposing the charged image carrier;

a developing unit which forms a visible image on the image carrier by developing the latent image;

a transfer unit which transfers the visible image to a recording medium;

a pre-transfer charge removing unit which removes charges of the image carrier before the visible image is transferred; and a controller which changes a charge removing quantity of the pre-transfer charge removing unit so that the charge removing quantity for a non-image area on the image carrier is larger than the charge removing quantity for an image area on the image carrier.

2. An image forming apparatus as claimed in claim 1, further comprising:

a charge removing unit which removes charges of the image carrier after the visible image is transferred.

3. An image forming apparatus as claimed in claim 2, wherein said controller, when the pre-transfer charge removing unit removes the non-image area, sets the charge removing quantity of the pre-transfer charge removing unit so that the surface potential of the non-image area is reduced to a residual potential level of the surface of the image carrier having passed the charge removing unit.

4. An image forming apparatus as claimed in claim 1, wherein said controller, when the pre-transfer charge removing unit removes the image area, sets the charge removing quantity of the pre-transfer charge removing unit to an optimum value so that the surface potential of a background area in the image area is at a level that prevents the central parts of letters from missing and restrains the spread of toner in the periphery of letters.

5. An image forming apparatus as claimed in claim 1, wherein said developing unit forms a visible image on the image carrier by reversal development using toner charged to a polarity the same as the polarity of the latent image.

6. An image forming apparatus comprising:

a photoreceptor being rotated;

a charger which uniformly charges the photoreceptor surface;

an exposing device which forms an electrostatic latent image on the photoreceptor surface;

a developing unit which forms a toner image corresponding to the latent image by causing toner to adhere to the photoreceptor surface;

a pre-transfer eraser which removes charges of the photoreceptor surface by exposing the photoreceptor surface after the toner image is developed;

a transfer unit which transfers the toner image to a sheet of paper;

a charge removing unit which removes charges of the photoreceptor surface after the toner image is transferred by the transfer unit; and a controller which controls the light quantity of the pre-transfer eraser so that the light quantity for a non-image area on the photoreceptor is larger than the light quantity for an image area on the photoreceptor, said non-image area is not in contact with the sheet of paper and said image area is to be in contact with the sheet of paper.

7. An image forming apparatus as claimed in claim 6, wherein said controller, when the pre-transfer eraser exposes the non-image area, sets the light quantity of the pre-transfer eraser so that the surface potential of the non-image area is reduced to a residual potential level of the surface of an image carrier having passed the charge removing unit.

8. An image forming apparatus as claimed in claim 6, wherein said controller, when the pre-transfer eraser exposes the image area, sets the light quantity of the pre-transfer eraser to an optimum value so that the surface potential of a background area in the image area is at a level that prevents the central parts of letters from missing and restrains the spread of toner in the periphery of letters.

9. An image forming apparatus as claimed in claim 6, wherein said developing unit forms a toner image on an image carrier by reversal development using toner charged to a polarity the same as the polarity of the latent image.

10. An image forming apparatus comprising:

an image forming unit which forms a toner image on an image carrier based on an input image;

a transfer unit which transfers the formed toner image to a recording medium;

a pre-transfer eraser which irradiates the image carrier with light at a position in the upstream side of a transfer position; and a controller which controls the light quantity of the pre-transfer eraser so that the light quantity for a non-image area on the image carrier is larger than the light quantity for an image area on the image carrier.

11. An image forming apparatus as claimed in claim 10, further comprising:

a charge removing unit which removes charges of the image carrier after a visible image is transferred.

12. An image forming apparatus as claimed in claim 11, wherein said controller, when the pre-transfer eraser exposes the non-image area, sets the light quantity of the pre-transfer eraser so that the surface potential of the non-image area is reduced to a residual potential level of the surface of the image carrier having passed the charge removing unit.

13. An image forming apparatus as claimed in claim 10, wherein said controller, when the pre-transfer eraser exposes the image area, sets the light quantity of the pre-transfer eraser to an optimum value so that the surface potential of a background area in the image area is at a level that prevents the central parts of letters from missing and restrains the spread of toner in the periphery of letters.

* * * * *